US006524778B2

(12) United States Patent
Fyson et al.

(10) Patent No.: US 6,524,778 B2
(45) Date of Patent: Feb. 25, 2003

(54) PROCESSING PHOTOGRAPHIC MATERIAL

(75) Inventors: John R. Fyson, Hackney (GB); Nigel R. Wildman, Watford (GB); Robert A. Arcus, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/974,104

(22) Filed: Oct. 10, 2001

(65) Prior Publication Data

US 2002/0081536 A1 Jun. 27, 2002

(30) Foreign Application Priority Data

Nov. 3, 2000 (GB) ..... 0026957

(51) Int. Cl.[7] ..... G03C 5/26; G03C 5/38; G03C 7/30

(52) U.S. Cl. ..... 430/401; 430/403

(58) Field of Search ..... 430/401, 403

(56) References Cited

U.S. PATENT DOCUMENTS

| | | | | | |
|---|---|---|---|---|---|
| 2,947,236 | A | * | 8/1960 | Siegel | 396/635 |
| 3,668,997 | A | * | 6/1972 | Ratowsky | 134/120 |
| 3,693,529 | A | * | 9/1972 | Stabler | 396/617 |
| 3,705,544 | A | * | 12/1972 | Ratowsky | 396/573 |
| 3,905,584 | A | * | 9/1975 | Ratowsky | 366/200 |
| 3,982,259 | A | * | 9/1976 | Van Baerle | 137/625.21 |
| 4,005,463 | A | * | 1/1977 | Kowalski | 396/589 |
| 5,200,302 | A | | 4/1993 | Iwano | 430/376 |
| 5,234,802 | A | * | 8/1993 | Nakamura et al. | 430/403 |
| 5,928,845 | A | | 7/1999 | Feumi-Jantou | 430/432 |

FOREIGN PATENT DOCUMENTS

| | | |
|---|---|---|
| GB | 1 409 089 | 8/1975 |
| NL | 288 055 A | 3/1994 |

OTHER PUBLICATIONS

JP Abstract—56038042.

DD Abstract 98377.

* cited by examiner

*Primary Examiner*—Hoa Van Le

(57) ABSTRACT

A method of processing a silver halide photographic material comprises passing the material through a processing solution repeatedly at a temperature suitable for processing, the material spending the major part of the processing time out of the liquid, wherein said processing solution has a viscosity from 0.7 to 5 cP at the processing temperature.

6 Claims, 3 Drawing Sheets

PROCESSING PHOTOGRAPHIC MATERIAL

FIELD OF THE INVENTION

The invention relates to a method of processing silver halide photographic material.

BACKGROUND OF THE INVENTION

Conventional photographic paper and films are usually processed by passing a web of the material through a number of tanks containing the processing chemicals. It is usual for the web to be covered with liquid whilst in the tank, travelling through the air only when going from one tank to the next. This requires the tank to contain sufficient liquid to cover the film. To reduce the amount of liquid in the tank and to lower the effect of chemical decomposition, the spaces in the tank not occupied by the web being processed can be filled up giving, for example, a low volume thin tank (LVTT).

Another way of reducing the liquid volume is to have the web passing through a small amount of liquid, a 'puddle', in the bottom of the tank, picking up liquid on its way through, and thus a proportion of the processing takes place in the air above the tank. The web may pass through the liquid a number of times if the threaded path of the web is configured to do so. This may be a achieved by the web taking a helical path along a tank, before crossing over into an adjacent tank or by going up and down a number of times into the puddle in the general direction of movement of the web.

Another way of processing with a small amount of liquid is to have a short length of web e.g. a single film, affixed to the inside of a drum processor. Processing liquid is put in the drum such that a 'puddle' is formed at the bottom containing sufficient liquid to carry out the process. The drum is rotated such that the material is wetted as it passes through the puddle on each revolution of the drum. For most of the time in the process the web is being processed with the liquid picked up when it travels through the puddle. At the end of each process step, the processing solution may be drained from the drum and replaced with the solution for the next step.

It is known to add viscosity increasing agents to processing solutions that are to be used in lamination processes such as diffusion transfer where two webs are brought together e.g. the Polaroid peel apart process, diffusion transfer copying and plate making.

Viscosity increasing agents are often employed in 'single-use' processing where liquid is applied to the surface of a material and left until the process is complete. The high viscosity of this solution, often >1000 Cp, is require to put down sufficient chemical in one pass to complete the process. The processing liquid remains essentially stationary with respect to the web. Examples of this type of process are described in JP90014690 B (Konica) and DD98377 A (Keiler JA).

PROBLEM TO BE SOLVED BY THE INVENTION

The problem encountered with the processes where the web spends a portion of its time travelling in air, is that the liquid runs back into the puddle as the web leaves it leaving only a thin layer of liquid on the surface. As reactions in the film take place, the 'useful' chemicals in this layer are depleted by diffusion. If the web had been processed in stationary solution, a diffusion boundary layer would have built up. As these chemicals become depleted the rate of the process will be reduced increasing the processing time or causing change the sensitometry compared to a deep tank process. As the web returns to the liquid the surface layer will be renewed. Ideally the thickness of liquid carried on the surface of the film should exceed that of the diffusion boundary layer formed in the time that the web left the puddle and the time it returns to it. In this way the effects of the depletion in the surface layer will be minimised. It will be similar to that found in a deep tank with roller wipes hitting the film at the same rotation speed of the drum or the re-entry time of a continuous web.

Also there is a tendency for the web to 'de-wet' in the air above the liquid and the surface liquid either forms drops or runs to the middle causing an excess of liquid is some places and a deficiency in others. This leads to uneven processing.

It has been found that the run back and de-wetting can be reduced by increasing the viscosity of the processing solutions sufficiently to increase the amount of liquid adhering to the film, such that its thickness approaches that of the boundary layer thickness.

SUMMARY OF THE INVENTION

The invention provides a method of processing a silver halide photographic material which comprises passing the material through a processing solution repeatedly at a temperature suitable for processing, the material spending the major part of the processing time out of the liquid, wherein said processing solution has a viscosity from 0.7 to 5 cP at the processing temperature.

ADVANTAGEOUS EFFECT OF THE INVENTION

The invention allows more rapid processing in all processes, particularly in processes where diffusion control is important e.g. fixing.

More even processing is achieved as the liquid is more likely to be retained as a continuous film over the whole of the web's surface.

DETAILED DESCRIPTION OF THE INVENTION

Figure 1B:
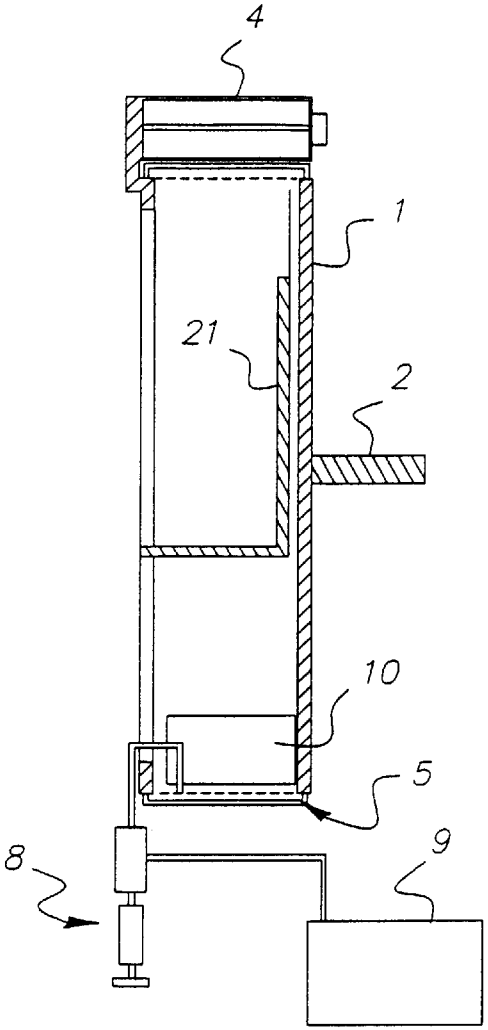
FIGS. 1A and 1B show a schematic side view and section view, respectively, of apparatus in which the method of the present invention can be performed.

Preferably a thickening agent is used to increase the viscosity of the processing solution to the desired viscosity.

Preferred thickening agents include a soluble polyacrylic acid or derivative thereof.

The temperature/viscosity profile of the thickening agent is important. Preferably, the solution is sufficiently mobile so that it can be transported at ambient temperatures and still be effective at processing temperatures. Soluble polyacrylic acid and its derivatives have suitable solution properties. Starch and cellulose ester solutions have too steep a temperature/viscosity profile, such that if enough is added at the processing temperature to give the required viscosity change, on cooling the mixture set to a gel or high viscosity solution that cannot be pumped.

Preferably, the viscosity of the process solution is increased such that sufficient liquid is maintained on the photographic web's surface to carry out the process efficiently, but is not so viscous so that all the liquid is pulled out on the web, causing the 'puddle' to disappear.

Preferably, the viscosity of the solution is not so great so as to make removal of that solution difficult before application of the next solution, or before entering a dryer.

The processing solution may be any of the known processing solutions commonly used in photographic processing e.g. developer, stop, bleach, fix and solutions having a combined function e.g. stop-fix.

The method of the invention may be used for any photographic silver halide material including colour negative or positive film or paper, colour paper, reversal or black and white film or paper.

Further information regarding the composition of a variety of photographic materials suitable for use in the present invention may be found in Section XI-XIV of Research Disclosure of September 1994 No 365 at pages 46–50.

Details of the development of photographic materials including examples of developing agents, preservatives, antifoggants, sequestering agents and other additives may be found in Section XIX of Research Disclosure of September 1994 No 365 at pages 60–62.

Details of desilvering, washing, rinsing and stabilizing of photographic materials including bleaching, fixing, bleach-fixing, washing, rinsing and stabilizing solutions may be found in Section XX of Research Disclosure of September 1994 No 365 at pages 63–66.

In a particular embodiment of the invention the process is carried out in a cylindrical drum which is rotated about the axis of the cylinder. A preferred form of this apparatus is a single use wave processor of the type described in our copending UK Patent Application No. 0023091.2, filed on Sep. 20, 2000 which describes an apparatus for processing a photographic material, comprising a chamber adapted to hold the material therein, means for introducing a metered amount of solution into the chamber, means for removing the solution from the chamber, means for rotating the chamber and means for sweeping the surface of the material at each rotation of the chamber, thereby to form a wave in the solution through which the material may pass.

Figure 1A:
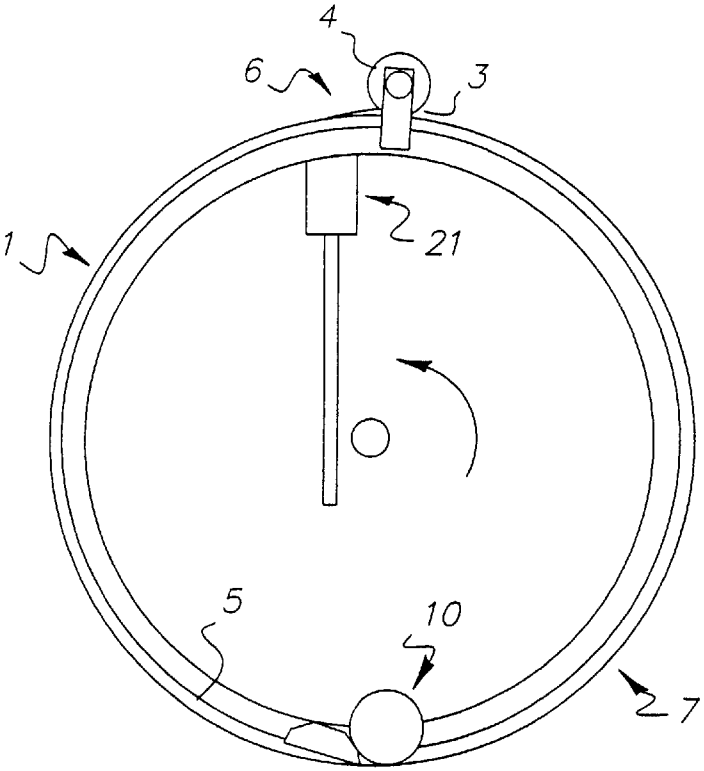

FIGS. 1A and 1B show an embodiment of a wave processor.

The wave processor comprises a cylinder 1 having at least one open end. The cylinder may be made of stainless steel, plastics or any other suitable material. A transparent material, such as polycarbonate, may be used if it is desired to scan the material while it is within the cylinder. The cylinder defines a processing chamber. An arm 3 is provided on the outer side of the cylinder for holding a film cassette 4. A slot 6 with a water tight cover (not shown) is provided through the wall of the cylinder to allow the strip of film 5 from the film cassette to enter the processing chamber. The watertight cover may be in the form of a hinged door having a rubber wedge. However, any suitable means may be used. A circular slot is defined around the inner circumference of the chamber for holding the strip of film 5 by the edges.

A second arm 21 is located within the chamber. This arm 21 grabs the tongue of the film and holds it against the inner circumference of the chamber.

A close fitting cover (not shown) may be provided around the inner circumference of the chamber which sits above the film surface by at least 0.5 mm. This cover provides at least three functions to improve the performance of the apparatus. Firstly it lowers water evaporation which can cause a temperature drop and can concentrate the processing solution as processing is occurring. Secondly it can itself provide agitation by maintaining a puddle of solution in the gap between the cover and the film surface at the lowest point of the chamber. Thirdly it provides a film retaining means making edge guides unnecessary, although edge guides can be also be provided to prevent the film sticking to the cover. It allows both 35 mm film and APS film (24 mm) to be loaded in the same apparatus and it also allows any length of film to be loaded. The material of the cover can be impervious to processing solution and as such is provided with a break or gap in its circumference so that the two extreme ends of the cover do not meet and through which processing solution is added to the film surface. In this embodiment the cover is fixed and rotates with the chamber as the chamber rotates. In another embodiment the cover is not fixed and rests on rails on each side which allow the cover to slide and remain stationary as the chamber rotates. In this embodiment the cover is again provided with a break or gap in its circumference so that processing solutions can be added to the film surface. In this embodiment a roller can also be provided which sits in the gap in the circumference of the cover and which remains essentially at the lowest point of the chamber. The roller provides additional agitation. In another embodiment the cover can be made of a material which is porous to processing solution such as a mesh material or a material punctured with holes. The cover can be made of plastic, metal, or any suitable material. However, the cover is not an essential feature of the invention.

A drive shaft 2 is provided at the closed end of the cylinder for rotation thereof. The open end of the cylinder 1 is provided with a flange 7. The flange retains solution within the chamber. In the embodiment shown in FIG. 1B the processing solutions are introduced into and removed from the chamber by means of syringes 8. However any suitable means may be used, for example metering pumps. The solutions may be introduced from a reservoir 9. Alternatively the solutions may be held in a cartridge prior to use. The cartridge can consist of part or all the processing solutions required to complete the process and is easily placed or "plugged in" the processor without the need to open or pour solutions. The cartridge can consist of an assembly of containers for each of the solutions required for the process. The solutions may be removed by suction or any other means. Residue of solutions therefore do not build up within the processing chamber. This results in the processing chamber being essentially self cleaning. The cross over times from one solution to another are very short. It is possible to mount an infra red sensor outside of the chamber. The sensor monitors the silver density of the material during development thereof. However this is not an essential feature of the invention.

A wave forming mechanism is provided within the processing chamber. This wave forming mechanism sweeps the film surface and forms a wave of solution, primarily at the lowest point in the chamber. In the embodiment shown in FIGS. 1A and 1B the mechanism is a free standing roller 10. It is possible that this roller may be held on a loose spindle, (not shown), which would allow the roller to be steered and also to be raised and lowered into position. The position of the roller can be changed with this mechanism so that it is to the left or right of bottom dead centre which can be advantageous for the smooth running of the roller. It is also desirable to raise or lower the roller which might facilitate film loading.

In operation a film cassette 4 is located in the arm 3 and held on the outside of the cylinder 1. The end of the film 5 is withdrawn from the cassette and entered into the processing chamber by means of the slot 6. The arm 21 holds the film against the inner circumference of the cylinder and the cylinder 1 is rotated so that the film 5 is unwound from the cassette and loaded into the processing chamber. The film is held in a circular configuration within the processing chamber. This loading is carried out while the processing chamber is dry although it is also possible to load the film if the chamber is wet. The film is held with the emulsion side facing inwards with respect to the chamber. It is also possible to load the film with the emulsion side facing outwards provided a gap is present between the film surface and the inner circumference of the chamber. Once loaded, the film is held by the edges thereof within the circular slot around the circumference of the chamber.

The processing chamber is heated. The chamber can be heated electrically or by hot air. Alternatively the chamber may be heated by passing the lower end thereof through a heated water bath. The chamber is then rotated. When the desired temperature is reached a given volume of a first processing solution is introduced into the chamber. The processing solution may be heated prior to being introduced into the chamber. Alternatively the solution may be unheated or cooled. As the chamber rotates the film is continuously re-wetted with the given volume of solution.

Processing solution is added onto the roller 10 which is contacted across the whole width thereof by a spreader 52. This can be seen in more detail in FIG. 2. The spreader may be made of flexible soft plastic, rigid plastic or any other suitable material. The roller 10 rotates in contact with the spreader 52. Processing solution is delivered, via a supply pipe, down the spreader to the region of contact between the roller and the spreader. This method forms a uniform bead of solution over the region of contact between the roller and the spreader which extends across the width of the roller 10. This allows uniform spreading of the processing solution onto the film 5 as it passes under the roller 10. It is also possible to add solutions very quickly by "dumping" a given volume into the chamber while it is rotating so that it immediately forms a "puddle" or wave in front of the roller. Yet another method is to add the processing solutions when the chamber is stationary to a region where there is no film or to a region where there is no image such as the fogged end of the film. The rotation of the chamber is then started after the solution has been added. The time interval between adding the solution and starting the rotation can be from zero to any desired hold time.

The roller 10 acts as a wave forming mechanism. This wave forming mechanism, in combination with the rotation of the chamber, provides very high agitation which gives uniform processing even with very active processing solutions. High agitation and mixing are required when only small volumes of solution are being used, in the order of about 0.5 ml. If a large volume of solution is added to the chamber in the absence of a wave forming mechanism a "puddle" of solution is formed and spreading and agitation is achieved. However if a small volume of solution is added to the chamber in the absence of a wave forming mechanism then solution adheres to the film as the chamber rotates. There is no "puddle" formed and there is consequently no agitation or mixing and processing is slow and non-uniform. The agitation and mixing mechanism of the present invention, i.e. the wave forming mechanism, is sufficient to minimise density differences from the front to the back of the film.

The processing solutions i.e. developer, bleach and fix may be added one after the other to the drum which is rotated during each stage. The processing solution of the preceding stage may be removed, conveniently by suction, before the next solution is added. After the wash stage the photographic material, usually film, is removed and the drum dried in preparation for the next photographic material to be processed.

EXAMPLE

Film used in these experiments was KODAK Royal Gold 400, an ISO 400 speed colour negative slit to 35 mm width. This was given an exposure in 0.2 log exposure steps. In all cases the length of the film to be processed was 775 mm.

Figure 2:
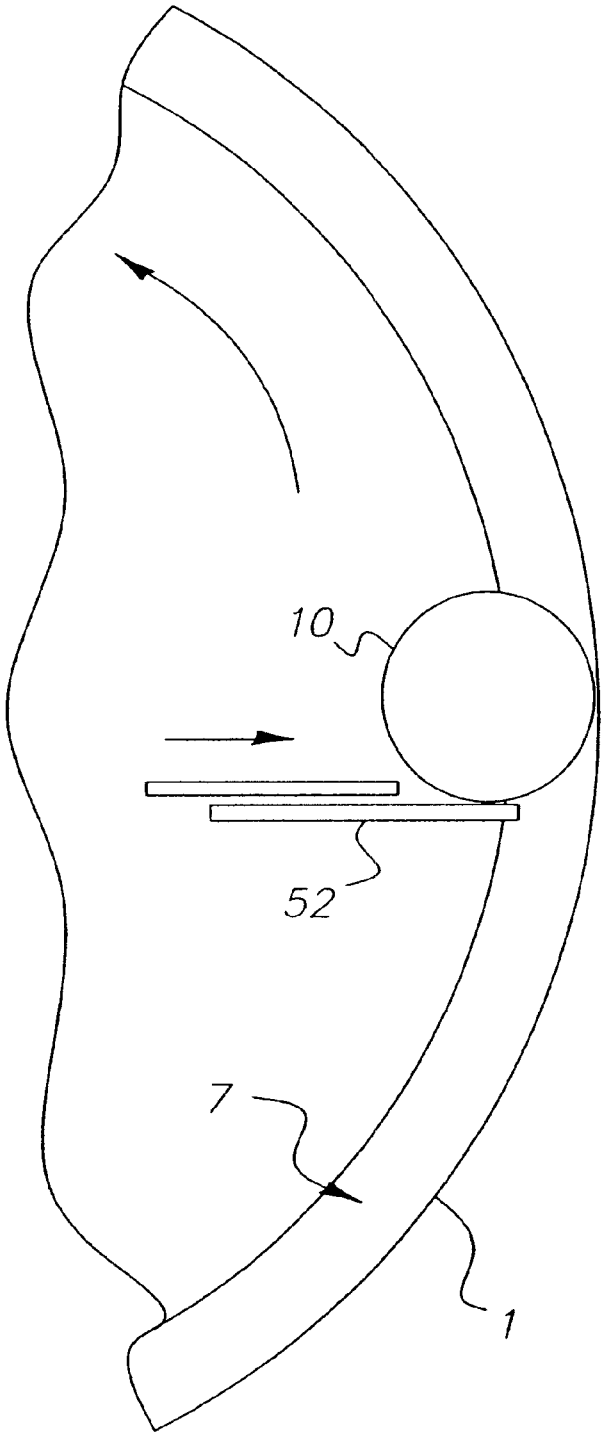
FIG. 2 is an enlarged view of the lower portion of the embodiment shown in FIGS. 1A and 1B.

Processing was carried out in a processor as described in a single use wave processor of the type described in FIGS. 1 and 2 above at 60° C. using the following solutions.

| | |
|---|---|
| Developer | |
| water | 500 ml |
| sodium sulfite | 10.55 g |
| sodium bromide | 2.8 g |
| hydroxylamine sulfate | 3.0 g |
| Anti-Cal #8 (40% solution) | 6.5 g |
| potassium carbonate | 40 g |
| CD-4 | 15 g |
| potassium iodide | 2 mg |
| PVP (K-15) | 3 g |
| Photoflo | 4 ml |
| water to | 1 liter |
| pH adjusted to 10.49 with potassium hydroxide or sulfuric acid | |
| Stop | |
| water | 950 ml |
| acetic acid | 50 ml |
| Bleach | |
| water | 500 ml |
| 1,3 propylenediacetic acid (PDTA) | 156.8 g |
| succinic acid | 70.8 g |
| ammonium bromide | 60 g |
| iron (III) nitrate 9 $H_2O$ | 188.1 g in 100 ml water |
| pH adjusted to 4 by adding .880 ammonia solution | |
| Photoflo | 4 ml |
| water to | 1 liter |
| pH readjusted to 4 | |
| Fix | |
| water | 500 ml |
| ammonium sulfite | 10 g |
| 56% (w/w) ammonium thiosulfate | 350 ml |
| disodium EDTA | 1.08 g |
| with (invention) and without (comparison) | |
| sodium salt of polyacrylic acid av. mw 20000 | 75 g |
| water to | 1 liter |
| pH adjusted to 7.90 with acetic acid or ammonia solution | |

The viscosity of this solution was measured using an Ostwald viscometer at 60° C. using water as a calibration standard. The viscosities without and with the polyacrylic acid were 0.535 and 1.075 cP respectively.

The tank was drained between each solution except between the developer and the stop. The process sequence and timings were as follows:

| Step | Volume added | Time |
|---|---|---|
| Develop | 20 ml | 30 s |
| Stop | 10 ml on top of developer | 15 s |
| Bleach | 10 ml | 40 s |
| Fix | As necessary | As necessary |
| Wash | 20 ml × 4 | 10 s × 4 |

Results

The results are expressed in the table below.

| Temp/ Agitation speed (rpm of drum) | Fixing time/volume for 775 mm of film | Fixer composition | Example | Clearing result |
|---|---|---|---|---|
| 60 C/60 rpm | 60 s/25 mL | Normal viscosity fixer | Control | Cleared |
| 60 C/60 rpm | 50 s/25 ml | Normal viscosity Fixer | Control | Not fully cleared |
| 60 C/60 rpm | 60 s/20 mL | Normal viscosity fixer | Control | Not fully cleared |
| 60 C/60 rpm | 50 s/20 mL | Normal viscosity fixer | Control | Not fully cleared |
| 60 C/60 rpm | 60 s/15 mL | Normal viscosity fixer | Control | Not fully cleared |
| 60 C/60 rpm | 50 s/15 mL | Normal viscosity Fixer | Control | Not fully cleared |
| 60 C/60 rpm | 50 s/25 ml | Higher viscosity Fixer | Invention | Cleared. |
| 60 C/60 rpm | 50 s/20 ml | Higher viscosity Fixer | Invention | Cleared. |
| 60 C/60 rpm | 50 s/15 ml | Higher viscosity Fixer | Invention | Cleared. |
| 60 C/60 rpm | 50 s/10 ml | Higher viscosity Fixer | Invention | Cleared. |

Figure 3:
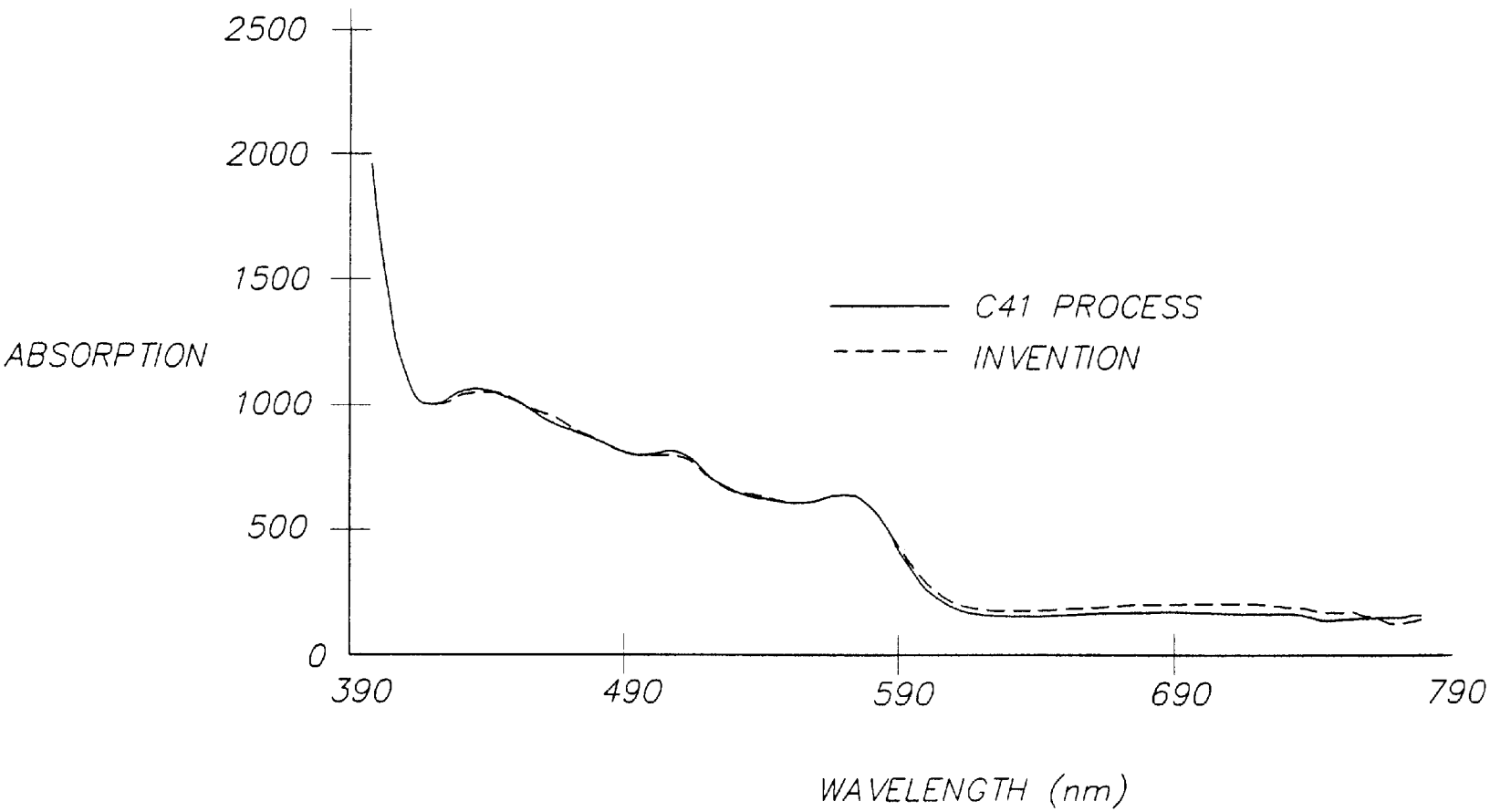
FIG. 3 is a graphical representation of spectral data obtained from the Example.

To make sure that the film was adequately fixed and that no sensitising dye stain resulted from the process the Dmin of one of the film strips was scanned on a Spectral Array Densitometer. The resultant spectra can be seen in FIG. 3 and shows that the film has been processed to the same standard as in the C41 process.

The invention has been described in detail with particular reference to certain preferred embodiments thereof, but it will be understood that variations and modifications can be effected within the spirit and scope of the invention.

What is claimed is:

1. A method of processing a silver halide photographic material which comprises passing the material through a processing solution repeatedly at a temperature suitable for processing, the material spending the major part of the processing time out of the liquid, wherein said processing solution has a viscosity from 0.7 to 5 cP at the processing temperature.

2. A method according to claim 1 wherein said processing solution has a viscosity from 0.8 to 3 cP at the processing temperature.

3. A method according to claim 1 wherein the desired viscosity is obtained by incorporating a thickening agent in the processing solution.

4. A method according to claim 3 wherein the thickening agent is a soluble polyacrylic acid or derivative thereof.

5. A method according to claim 1 wherein the processing solution is a fix solution.

6. A method according to claim 1 wherein the method is carried out in an apparatus for processing a photographic material, comprising a chamber adapted to hold the material therein, means for introducing a metered amount of solution into the chamber, means for removing the solution from the chamber, means for rotating the chamber and means for sweeping the surface of the material at each rotation of the chamber, thereby to form a wave in the solution through which the material may pass.

* * * * *